US005239927A

United States Patent [19]

Frye et al.

[11] Patent Number: 5,239,927

[45] Date of Patent: Aug. 31, 1993

[54] DECELERATION DEVICE FOR SUBMUNITION

[75] Inventors: Günter Frye, Erkrath; Karl-Heinz Vogt, Essen; Volker Bartels, Düsseldorf, all of Fed. Rep. of Germany

[73] Assignee: Rheinmetall GmbH, Düsseldorf, Fed. Rep. of Germany

[21] Appl. No.: 899,870

[22] Filed: Jun. 17, 1992

[30] Foreign Application Priority Data

Jul. 25, 1991 [DE] Fed. Rep. of Germany ..... 4124655

[51] Int. Cl.[5] ..... F42B 10/56

[52] U.S. Cl. ..... 102/387; 102/340; 102/348; 102/489

[58] Field of Search ..... 102/386, 387, 388, 393, 102/489, 337, 339, 340, 348, 354; 244/3.3

[56] References Cited

U.S. PATENT DOCUMENTS

| | | | |
|---|---|---|---|
| 3,055,300 | 9/1962 | Stoehr | 102/339 |
| 3,221,656 | 12/1965 | Sutten | 102/348 |
| 3,730,099 | 5/1973 | Schopp | 102/339 |
| 3,791,300 | 2/1974 | Prochnow et al. | 102/339 |
| 3,834,312 | 9/1974 | Simmons | 102/339 |
| 4,013,009 | 3/1977 | Claude et al. | 102/339 |
| 4,023,495 | 5/1977 | Fischer et al. | 102/337 |
| 4,226,185 | 10/1980 | Tobler et al. | 102/337 |
| 4,372,215 | 2/1983 | Crepin | 102/387 |
| 4,753,171 | 6/1988 | Stessen | 102/387 |
| 4,856,432 | 8/1989 | Synofzik | 102/489 |
| 5,111,748 | 5/1992 | Thurner et al. | 102/387 |

*Primary Examiner*—David M. Brown

*Attorney, Agent, or Firm*—Spencer, Frank & Schneider

[57] ABSTRACT

A deceleration device for a submunition unit includes a cartridge releasably attached to the submunition unit. A releasable package including at least one pocket is disposed in the cartridge and is connected to the cartridge by a packaging line. An auxiliary parachute and a rotation parachute are disposed in the cartridge, with at least the rotation parachute being accommodated in the at least one pocket of the releasable package and the auxiliary parachute being disposed in a pocket separate from the at least one pocket. The auxiliary parachute is connected to the cartridge and the rotation parachute is connected to the submunition unit. A deployment mechanism causes the auxiliary parachute to be deployed in advance of the rotation parachute after the cartridge is released from the submunition unit and the rotation parachute to be deployed after the cartridge is decelerated by the auxiliary parachute for decelerating the submunition unit.

2 Claims, 1 Drawing Sheet

DECELERATION DEVICE FOR SUBMUNITION

BACKGROUND OF THE INVENTION

The present invention relates to a deceleration device for a submunition in which a cartridge releasably attached to the submunition unit includes an auxiliary parachute and a rotation parachute, with the auxiliary parachute being connected to the cartridge and the rotation parachute being connected to the submunition unit.

In order to decelerate submunition projectiles ejected rearwardly from a spin stabilized carrier projectile, it is known to provide a deceleration device which is disposed at the tail of the submunition projectile and is activated by the ejection process to decelerate the submunition projectile.

The deceleration device may include a cartridge, which is releasably fastened to the tail of the submunition unit, accommodates an auxiliary parachute and a rotation parachute, with the auxiliary parachute being connected to the cartridge and the rotation parachute being to the submunition unit whose tail end constitutes the bottom of the cartridge. The purpose of the auxiliary parachute is to prevent a collision between the rotation parachute and the cartridge. However, in spite of shielding effects caused by the rotation parachute, the simultaneous activation frequently results in a collision between the cartridge and the rotation parachute.

SUMMARY OF THE INVENTION

It is an object of the present invention to provide a deceleration device of the type first described above in which a collision between the rotation parachute and the cartridge is reliably avoided.

The above and other objects are accomplished in accordance with the invention by the provision of a deceleration device forming a combination with a submunition unit and comprising: a cartridge releasably attachment to the submunition unit; a releasable package including at least one pocket disposed in the cartridge; a packaging line connecting the releasable package to the cartridge; an auxiliary parachute and a rotation parachute disposed in the cartridge, with at least the rotation parachute being accommodated in the at least one pocket of the releasable package and the auxiliary parachute being disposed in a pocket separate from the at least one pocket, the auxiliary parachute being connected to the cartridge and the rotation parachute being connected to the submunition unit; and deployment means for causing the auxiliary parachute to be deployed in advance of the rotation parachute after the cartridge is released from the submunition unit and for causing the rotation parachute to be deployed after the cartridge is decelerated by the auxiliary parachute for decelerating the submunition unit.

The invention will now be described in greater detail with reference to an embodiment thereof that is shown in a schematic representation in the attached drawing figures.

DETAILED DESCRIPTION OF PREFERRED EMBODIMENTS

Figure 1:
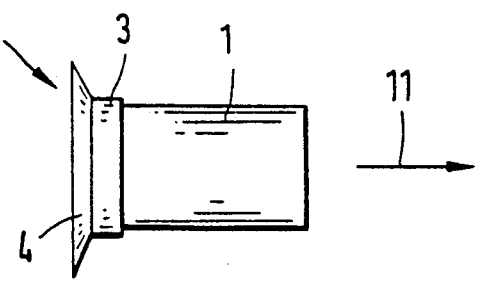
FIG. 1 is a side view of a submunition unit at the onset of the activation of the deceleration device.
Figure 2:
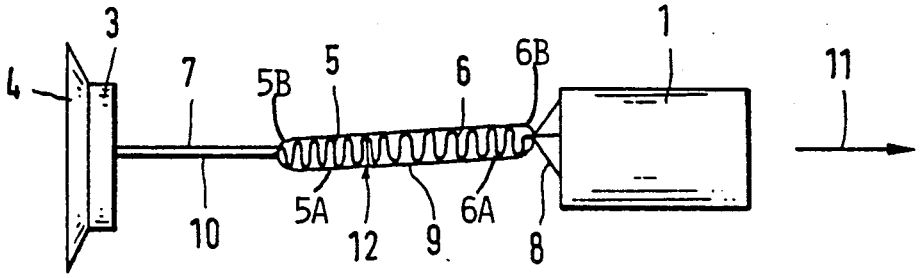
FIGS. 2 to 4 are side views depicting the submunition unit and the deceleration device of FIG. 1 in various phases of activation.

Referring to FIG. 1, there is shown a submunition unit 1 provided at its tail with a deceleration device 2 which includes a cartridge 3 that is releasably connected with submunition unit 1. Cartridge 3 is provided with a braking disc 4 which has a larger diameter than cartridge 3 and submunition unit 1. After ejection of submunition unit 1 from a spin stabilized carrier projectile (not shown), the torque exerted on braking disc 4 as a result of submunition unit 1 continuing to move essentially at the velocity and with the spin of the carrier projectile causes braking disc 4 to expand and thus exert a corresponding braking force on cartridge 3 so that the latter is released from submunition unit 1 as shown in FIG. 2. A spin stabilized carrier projectile which includes submunition units employing braking discs is described in greater detail in U.S. Pat. No. 4,856,432, the disclosure of which is incorporated herein by reference.

Cartridge 3 accommodates an auxiliary parachute 5 and a rotation parachute 6. Auxiliary parachute 5 is connected with cartridge 3 by way of an activation line 7 while rotation parachute 6 is connected with the tail surface of submunition unit 1 by way of a corresponding articulation 8 composed, for example, of lines.

Auxiliary parachute 5 is accommodated in a separate pocket from that of rotation parachute 6. In the illustrated embodiment this is realized in that a releasable package 9 is provided for parachutes 5 and 6 in the form of a double pack sack which is open toward both ends and is composed of one pocket 6A having an opening 6B facing submunition unit 1 for accommodating rotation parachute 6 and another pocket 5A having an opening 5B facing cartridge 3 for accommodating auxiliary parachute 5. Releasable package 9 is connected with cartridge 3 by way of a packaging line 10.

Figure 3:
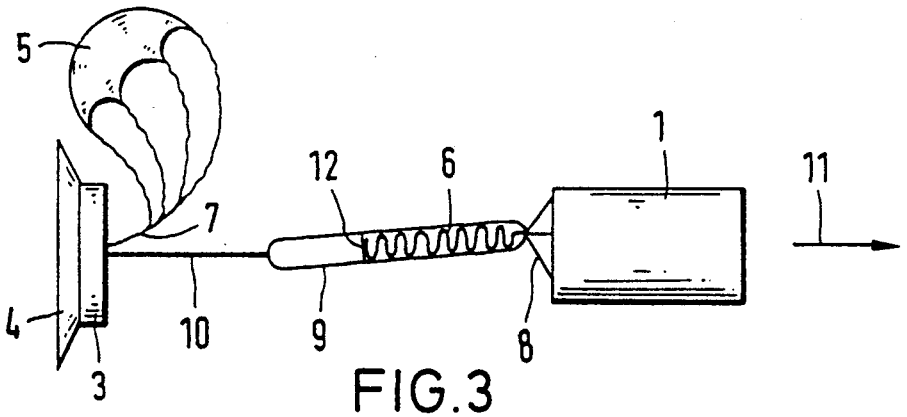
Figure 4:
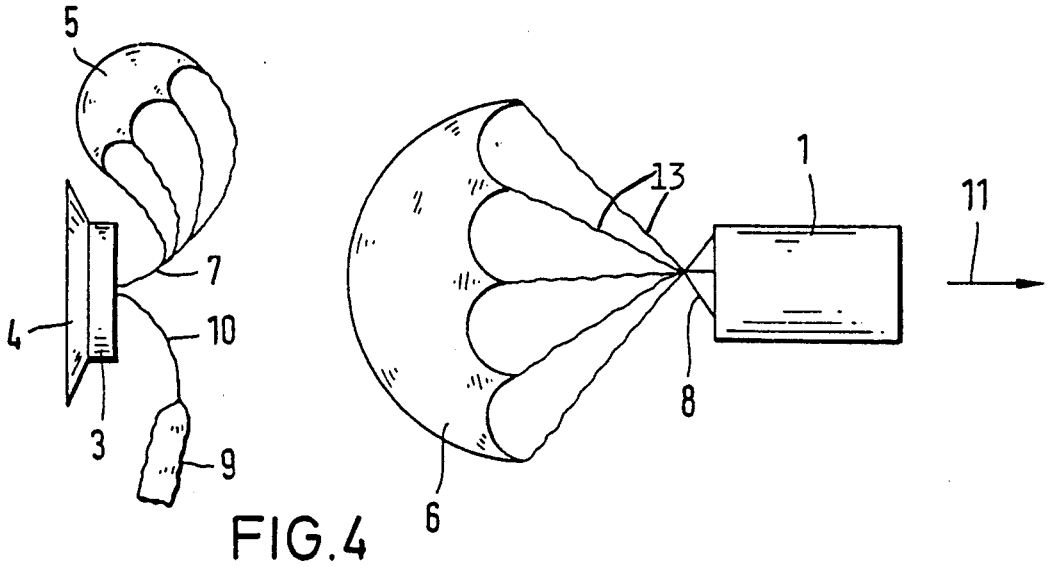

When brake disc 4 of cartridge 3 decelerates the latter relative to submunition unit 1 in a direction opposite its direction of flight as shown by arrow 11 in FIGS. 2 to 4, releasable package 9 together with activation line 7 and packaging line 10 is initially released from cartridge 3 (FIG. 2). The pull exerted by cartridge 3 on activation line 7 causes auxiliary parachute 5 to be deployed in that it is pulled out of its pocket 5A, while packaging line 10 is not yet tensioned (FIG. 3). Auxiliary parachute 5 enters into the exterior air stream and thus is flipped backwards so that cartridge 3 is held back with a greater force relative to submunition unit 1. This causes packaging line 10 to be tensioned and the double pack sack to be pulled away from rotation parachute 6 so that the latter is able to be deployed via opening without danger of collision with cartridge 3. Cartridge then 3 drops to the ground separately, held by auxiliary parachute 5 as shown in FIG. 4.

An intended break seam 12 provided between pockets 5A and 6A of releasable package 9 serves to support a controlled release of auxiliary parachute 5 in loops from its pocket 5A before rotation parachute 6 is pulled out of its pocket 6A.

In order to reliably avoid twisting of the rigging lines 13 of rotation parachute 6 when it is released, the packaging for rotation parachute 6, in this case package 9 is preferably fastened to cartridge 3.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A deceleration device forming a combination with a submunition unit and comprising:

a cartridge releasably attached to said submunition unit;

a releasable package including at least one pocket disposed in the cartridge;

a packaging line connecting said releasable package to said cartridge;

an auxiliary parachute and a rotation parachute disposed in said cartridge, with at least said rotation parachute being accommodated in said at least one pocket of said releasable package and said auxiliary parachute being disposed in a pocket separate from said at least one pocket, said auxiliary parachute being connected to said cartridge and said rotation parachute being connected to said submunition unit; and deployment means for causing said auxiliary parachute to be deployed in advance of said rotation parachute after said cartridge is released from said submunition unit and for causing said rotation parachute to be deployed after said cartridge is decelerated by said auxiliary parachute for decelerating said submunition unit;

wherein said releasable package comprises a double sack having opposite ends, said at least one pocket includes two separate pockets each having an opening at a respective one of the opposite ends, with one of the opposite ends facing the cartridge and the auxiliary parachute being disposed in the pocket having its open end facing said cartridge.

2. A combination as defined in claim 1, wherein said double sack includes an intended break seam connecting said two separate pockets.

* * * * *